US006939203B2

(12) United States Patent
Talieh et al.

(10) Patent No.: US 6,939,203 B2
(45) Date of Patent: Sep. 6, 2005

(54) FLUID BEARING SLIDE ASSEMBLY FOR WORKPIECE POLISHING

(75) Inventors: Homayoun Talieh, San Jose, CA (US); Douglas W. Young, Sunnyvale, CA (US)

(73) Assignee: ASM Nutool, Inc., Fremont, CA (US)

( * ) Notice: Subject to any disclaimer, the term of this patent is extended or adjusted under 35 U.S.C. 154(b) by 0 days.

(21) Appl. No.: 10/632,481

(22) Filed: Aug. 1, 2003

(65) Prior Publication Data

US 2004/0087259 A1 May 6, 2004

Related U.S. Application Data

(63) Continuation-in-part of application No. 10/614,311, filed on Jul. 7, 2003, which is a continuation of application No. 10/126,464, filed on Apr. 18, 2002, now Pat. No. 6,589,105, and a continuation of application No. 10/126,469, filed on Apr. 18, 2002, now Pat. No. 6,634,935.

(60) Provisional application No. 60/400,542, filed on Aug. 2, 2002.

(51) Int. Cl.[7] ..... B24B 21/10

(52) U.S. Cl. ..... 451/11; 451/297; 451/168

(58) Field of Search ..... 451/11, 162, 164, 451/168, 288, 296, 297, 340, 488–490, 513

(56) References Cited

U.S. PATENT DOCUMENTS

| | | | | |
|---|---|---|---|---|
| 669,923 | A | 3/1901 | Grauert | |
| 3,888,050 | A | 6/1975 | Elm | |
| 4,412,400 | A | 11/1983 | Hammond | |
| 4,802,309 | A | 2/1989 | Heynacher | |
| 4,895,486 | A * | 1/1990 | Baker et al. | 414/331.15 |
| 5,245,796 | A | 9/1993 | Miller et al. | |
| 5,335,453 | A | 8/1994 | Baldy et al. | |
| 5,377,452 | A | 1/1995 | Yamaguchi | |

(Continued)

FOREIGN PATENT DOCUMENTS

| | | |
|---|---|---|
| DE | 3113204 | 10/1982 |
| EP | 0 517 594 | 12/1992 |
| EP | 0 941 806 A2 | 9/1999 |
| EP | 1 025 955 A2 | 8/2000 |
| WO | WO 97/20660 | 6/1997 |
| WO | WO 98/45090 | 10/1998 |
| WO | WO 99/22908 | 5/1999 |
| WO | WO 00/32356 | 6/2000 |
| WO | WO 02/02272 A1 | 1/2002 |

OTHER PUBLICATIONS

Steigerwald et al., "Pattern geometry effects in the chemical–mechanical polishing of inlaid copper structures," Oct. 1994, pp. 2842–2848.

*Primary Examiner*—David B. Thomas
(74) *Attorney, Agent, or Firm*—Knobbe Martens Olson & Bear LLP

(57) ABSTRACT

A fluid bearing polishing apparatus for carrying a polishing member for chemical mechanical polishing includes a fluid supply and a fluid dispensing structure to support the polishing member. A method of polishing a workpiece includes supporting a polishing member on a fluid bearing between a first end of the polishing member and a second end of the polishing member and moving the polishing member to polish the workpiece. The fluid bearing has a curved portion at which plane of travel of the polishing member changes from a first plane to a second plane. Advantages of the invention include smooth belt motion in all desired directions of movement.

23 Claims, 9 Drawing Sheets

U.S. PATENT DOCUMENTS 5,377,453 A 1/1995 Perneczky
5,429,733 A 7/1995 Ishida
5,473,433 A * 12/1995 Miller ..... 356/514
5,489,235 A 2/1996 Gagliardi et al.
5,558,568 A 9/1996 Talieh et al.
5,593,344 A * 1/1997 Weldon et al. ..... 451/296
5,607,341 A * 3/1997 Leach ..... 451/41
5,650,039 A 7/1997 Talieh
5,679,212 A 10/1997 Kato et al.
5,707,409 A 1/1998 Martin et al.
5,759,918 A 6/1998 Hoshizak et al.
5,762,751 A 6/1998 Bleck et al.
5,770,521 A 6/1998 Pollock
5,807,165 A 9/1998 Uzoh et al.
5,810,964 A 9/1998 Shiraishi
5,851,136 A 12/1998 Lee
5,866,436 A * 2/1999 Miller ..... 438/16
5,893,755 A 4/1999 Nakayoshi
5,899,798 A 5/1999 Trojan et al.
5,899,801 A 5/1999 Tolles et al.
5,908,530 A 6/1999 Hoshizaki et al.
5,913,716 A 6/1999 Mucci et al.
5,951,368 A 9/1999 Watanabe et al.
5,951,377 A 9/1999 Vaughn et al.
5,961,372 A 10/1999 Shendon
5,975,988 A 11/1999 Christianson
6,017,831 A 1/2000 Beardsley et al.
6,048,789 A * 4/2000 Vines et al. ..... 438/633
6,068,542 A 5/2000 Hosokai
6,093,086 A * 7/2000 Easter et al. ..... 451/41
6,110,025 A 8/2000 Williams et al.
6,113,479 A 9/2000 Sinclair et al.
6,126,518 A * 10/2000 Jacquinot et al. ..... 451/41
6,126,527 A * 10/2000 Kao et al. ..... 451/307
6,129,540 A 10/2000 Hoopman et al.
6,135,859 A 10/2000 Tietz
6,136,715 A 10/2000 Shendon et al.
6,146,248 A * 11/2000 Jairath et al. ..... 451/41
6,179,690 B1 1/2001 Talieh
6,224,465 B1 * 5/2001 Meyer ..... 451/41
6,241,583 B1 6/2001 White
6,291,350 B1 * 9/2001 Hashimoto et al. ..... 438/692
6,302,767 B1 10/2001 Tietz
6,312,319 B1 11/2001 Donohue et al.
6,376,361 B1 * 4/2002 Chooi et al. ..... 438/631
6,379,231 B1 4/2002 Birang et al.
6,380,084 B1 * 4/2002 Lim et al. ..... 438/687
6,383,933 B1 * 5/2002 Shu et al. ..... 438/692
6,413,873 B1 7/2002 Li et al.
6,419,559 B1 7/2002 Gurusamy et al.
6,428,394 B1 8/2002 Mooring et al.
6,439,978 B1 8/2002 Jones et al.
6,464,571 B1 10/2002 Talieh et al.
6,468,139 B1 10/2002 Talieh et al.
6,475,070 B1 11/2002 White
6,500,056 B1 12/2002 Krusel et al.
6,561,870 B2 * 5/2003 Saldana et al. ..... 451/10
6,589,105 B2 7/2003 Young et al.
6,604,988 B2 8/2003 Talieh et al.
6,634,935 B2 10/2003 Young et al.
6,692,947 B2 2/2004 Walke et al.
6,729,945 B2 * 5/2004 Xu et al. ..... 451/303
6,736,710 B2 5/2004 Osawa et al.
6,769,970 B1 * 8/2004 Taylor et al. ..... 451/59
6,790,128 B1 * 9/2004 Taylor et al. ..... 451/41
2001/0044210 A1 * 11/2001 Nakabayashi et al. ..... 438/692
2002/0014661 A1 * 2/2002 Okamoto et al. ..... 257/347
2002/0123298 A1 9/2002 Krussel et al.

* cited by examiner

FLUID BEARING SLIDE ASSEMBLY FOR WORKPIECE POLISHING

CROSS-REFERENCE TO RELATED APPLICATIONS

This application is a continuation in part of U.S. Ser. No. 10/614,311 filed Jul. 7, 2003 (NT-251C1), which is a continuation of U.S. Ser. No. 10/126,464 filed Apr. 18, 2002 (NT-251) now U.S. Pat. No. 6,589,105, and U.S. Ser. No. 10/126,469 filed Apr. 18, 2002 (NT-253), now U.S. Pat. No. 6,634,935 all incorporated herein by reference.

This application claims priority to U.S. Prov. No. 60/400,542, filed Aug. 2, 2002 (NT-275P), incorporated herein by reference.

FIELD

The present invention relates to a fluid bearing slide assembly for workpiece polishing. The exemplary embodiments relate to the manufacture of semiconductor wafers, and more particularly to a system and method for a polishing member transport in a chemical mechanical polishing apparatus.

BACKGROUND

U.S. Pat. No. 6,103,628, assigned to the assignee of the present invention, describes a reverse linear chemical mechanical polisher, also referred to as bi-directional linear chemical mechanical polisher that operates to use a bi-directional linear motion to perform chemical mechanical polishing. In use, a rotating wafer carrier within a polishing region holds the wafer being polished. U.S. Pat. No. 6,103,628 is incorporated herein by reference.

U.S. Pat. Nos. 6,464,571 and 6,468,139, assigned to the assignee of the present invention and related to the '628 patent, describe various features of a reverse linear chemical mechanical polisher, including incrementally moving the polishing pad that is disposed between supply and receive spools. U.S. Pat. Nos. 6,464,571 and 6,468,139 are incorporated herein by reference.

While the mechanisms shown and described in these patents typically use roller bearings for supporting the polishing pad, roller bearings may have certain characteristics that affect polishing action, for example, in a reciprocating polishing apparatus, rotational momentum must be reversed whenever the belt direction is reversed. The act of overcoming roller bearing momentum may cause temporary or permanent belt stretching or other unwanted distortion, which can affect the polishing action. Additionally, while the inventions described in the patents are advantageous, further novel refinements are described herein which provide for a more efficient drive system for reverse linear, e.g. bi-directional linear, motion.

SUMMARY

The invention is a fluid bearing assembly for supporting a polishing member while polishing a workpiece. The polishing member may be, for example, a polishing pad, a polishing belt, or another type of polishing member. The fluid bearing assembly of the invention overcomes potential disadvantages of the conventional ball bearing rollers in which the polishing member mechanically contacts the roller surface.

An exemplary apparatus for polishing a workpiece comprises a polishing member configured to polish the workpiece. A support structure is coupled to the polishing member and configured to move the polishing member to polish the workpiece. The support structure includes at least one curved fluid bearing coupled to the polishing member and configured to support the polishing member while it is moved to polish the workpiece.

In one aspect of the invention, the fluid bearing supports the polishing member over a region where the polishing pad plane of travel changes from a first plane to a second plane.

In another one aspect of the invention, the apparatus further comprising a pressure regulator configured to control pressure of a fluid exhausted from the fluid bearing.

In another one aspect of the invention, the apparatus further comprising a temperature regulator configured to control temperature of a fluid exhausted from the fluid bearing.

In another one aspect of the invention, the support structure includes at least two curved fluid bearings coupled to the polishing member and configured to support the polishing member while it is moved to polish the workpiece.

In another one aspect of the invention, the fluid bearing is a substantially hollow structure with a curved portion constructed from perforated sheet metal.

In another one aspect of the invention, the support structure includes a supply spool configured to supply the polishing member and a receive spool configured to receive the polishing member; and a slide member coupled to the supply spool and the receive spool and configured to move the polishing pad in a bi-linear manner.

The invention offers many advantages, including the ability to efficiently produce reverse linear motion for a chemical mechanical polishing apparatus. Another advantage of the invention is to provide for the ability to efficiently produce bi-directional linear motion in a chemical mechanical polishing apparatus that also allows for the incremental movement of the polishing member. Yet another advantage is that angular momentum on the prior art rollers and polishing member is reduced. These advantages create smooth belt motion in all desired directions of movement.

BRIEF DESCRIPTION OF THE DRAWINGS

The invention is described with reference to the following figures wherein.

DETAILED DESCRIPTION

U.S. Pat. Nos. 6,103,628 and 6,589,105, which are hereby expressly incorporated by reference, describe a reverse linear polisher for use in polishing a workpiece (e.g. a semiconductor wafer). The embodiments described herein are for purposes of satisfying the best mode of the invention and may be modified while remaining within the scope of the claims.

Figure 1:
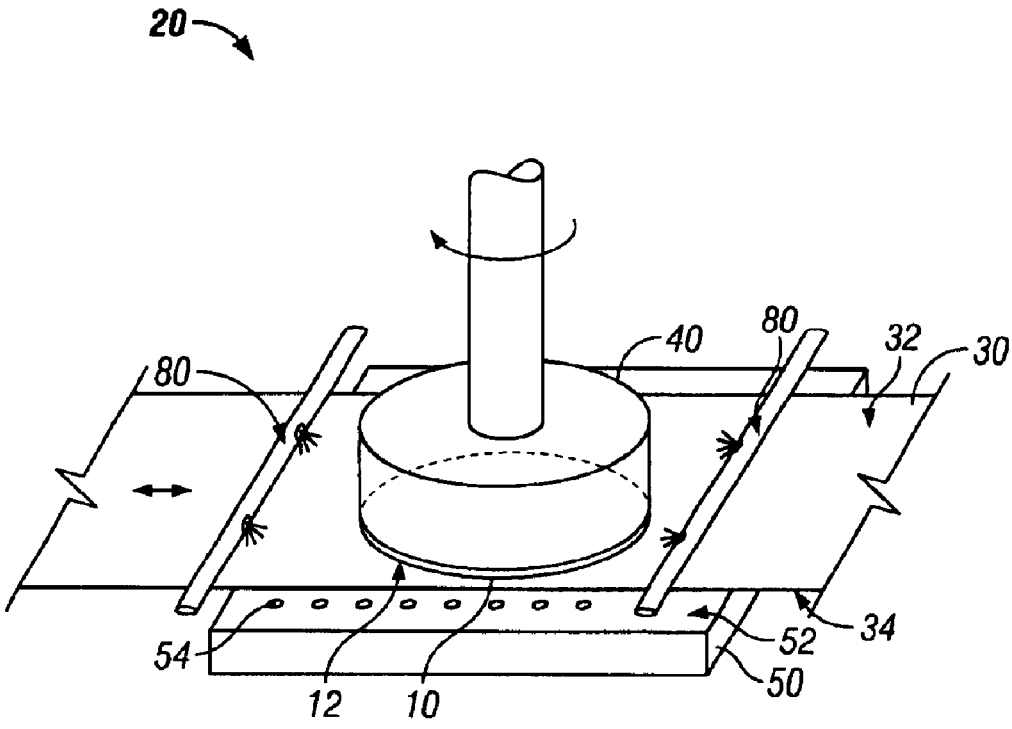
FIG. 1 illustrates a processing area for polishing a workpiece.

FIG. 1 illustrates a processing area 20 as described referenced patents. A polishing member 30 is moved in the processing area to polish the workpiece. In the exemplary embodiment, the polishing member is a pad that is moved in a reverse linear manner (i.e. bi-directionally) for polishing the front surface 12 of a wafer 10 within the processing area 20. The polishing member may be, for example, a polishing pad, a polishing belt, or another type of polishing member. The polishing member is driven by a drive mechanism (not shown). The wafer 10 is held in place by a wafer carrier 40 which can also rotate during a polishing operation as described herein.

Below the polishing member 30 is a platen support 50. During operation, due to a combination of tensioning of the polishing member 30 and the emission of a fluid, such as air, water, or a combination of different fluids from openings 54 disposed in the top surface 52 of the platen support 50, the bi-linearly moving portion of the polishing member 30 is supported above the platen support 50 in the processing area, such that a frontside 32 of the polishing member 30 contacts the front surface 12 of the wafer 10, and a backside 34 of the polishing member 30 levitates over the top surface 52 of the platen support 50.

While the portion of the polishing member 30 within the processing area moves in a bi-linear manner, the two ends of the polishing member 30 are preferably connected to supply and receive spools 102 and 104 illustrated in FIG. 2, allowing for incremental portions of the polishing member 30 to be placed into and then taken out of the processing area, as described in U.S. Pat. No. 6,589,105 and below.

Further, during operation, various polishing agents without abrasive particles or slurries with abrasive particles can be introduced, depending upon the type of polishing member 30 and the desired type of polishing, using nozzles 80. For example, the polishing member 30 can contain abrasives embedded in the frontside 32, and can also be used with polishing agents if desired. Or a polishing member 30 can be used that does not contain such embedded abrasives but instead uses a slurry. Alternatively, some other combination of polishing member, slurry and/or polishing agents can be used. The polishing agent or slurry may include a chemical that oxidizes the material that is subsequently mechanically removed from the wafer. A polishing agent or slurry that contains colloidal silica, fumed silica, alumina particles etc., is generally used with an abrasive or non-abrasive polishing member. As a result, high profiles on the wafer surface are removed until an extremely flat surface is achieved.

While the polishing member can have differences in terms of whether or not it contains abrasives, any polishing member 30 according to the invention should be sufficiently flexible and light so that a variable fluid flow from the openings on the platen support can affect the polishing profile at various locations on the wafer. Further, it is preferable that the polishing member be made from a single body material, which may or may not have abrasives impregnated therein. In this context, a single body material means a single layer of material, or, if more than one layer is used, flexibility is maintained by use of a thin polymeric material as described herein.

An example of a polishing member that contains these characteristics is the fixed abrasive pad MWR66 marketed by 3M company. The MWR66 is 6.7 mils (0.0067 inches) thick and has a density of 1.18 g/cm$^3$. As stated above, polishing members are preferably made of a flexible material, such as a polymer. Additionally, the polishing members preferably have a thickness in the range of 4–15 mils. Given such polishing member properties, variation of the pressure of the fluid that is exhausted from the openings on the platen support by less than 1 psi can significantly affect the degree of polishing that occurs on the front face of the wafer, as explained further hereinafter.

The manner in which the polishing member is used, i.e. whether the movement of the polishing member is linear, bi-linear, or non-constant, may affect the type of polishing members that can be used. However, use of polishing members other than the preferred types of polishing members described above with reference to FIG. 1 may result in less effective polishing. Polymeric pads having a low density, such as a density of less than 0.5 g/cm$^2$, may be acceptable due to the flexibility inherent to polymeric pads.

Another consideration with respect to the polishing member is its width relative to the diameter of the wafer being polished. The width of the polishing member may substantially correspond to the width of the wafer, or be greater or less than the width of the wafer.

The polishing member 30 may be substantially optically transparent at some wavelength, so that a continuous polishing member, without any cutout windows, can allow for detection of the removal of a material layer (endpoint detection) from the front surface 12 of the wafer 10. Additionally, a feedback loop may be implemented based upon signals related to endpoint detection to ensure uniform polishing of the wafer and/or polishing of all of the various regions of the wafer to the desired extent.

The platen support 50 may be made of a hard and machineable material, such as titanium, stainless steel or hard polymeric material. The machineable material allows formation of the openings 54, as well as channels that allow the fluid to be transmitted through the platen support to the openings. The polishing member levitates above the platen support due to the fluid that is exhausted from the openings. The exhausted fluid may be any fluid medium, such as air, water or some other fluid. By levitating the polishing member, the exhausted fluid causes the polishing member to press against the wafer surface during chemical mechanical polishing. The temperature and/or pressure of the fluid that is exhausted from the openings 54 may be controlled for optimum polishing conditions.

Figure 2A:
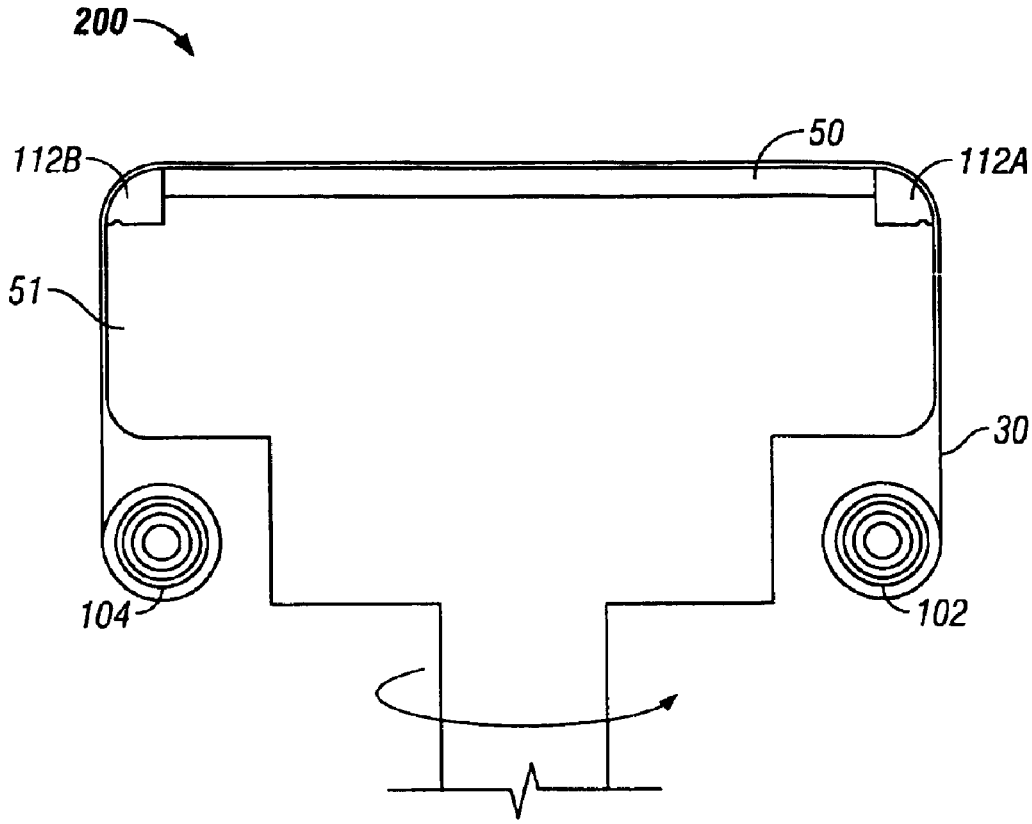
FIGS. 2A–B illustrate a polishing apparatus using a rotating platen assembly according to an embodiment of the invention.
Figure 2B:
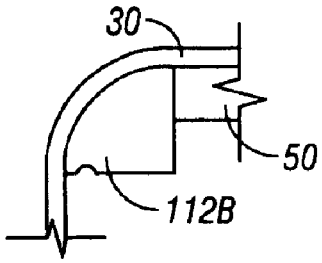

FIG. 2A illustrates a polishing apparatus 200 that uses a rotating platen assembly. The assembly includes a platen 50 held by a support structure 51. A polishing member 30 is extended between a supply spool 102 and a receiving spool 104. In the polishing apparatus, the polishing member is held motionless on the platen by applying vacuum suction through the platen. During the polishing process, the assembly is rotated against a surface of a wafer to be polished. A pair of fluid bearings 112A and 112B is placed at both ends of the platen, facing opposing directions. From the supply spool, the polishing member passes over a first fluid bearing 112A, the platen, a second fluid bearing 112B and the receiving spool. In this embodiment, fluid pressure is applied through the fluid bearings when the polishing member is advanced to bring a fresh polishing member section over the processing area. FIG. 2B shows the polishing member elevated by the fluid bearing 112B in the vicinity of the receiving spool. The bearing 112A operates in the same manner, in the vicinity of the supply spool. In operation, after each use of the portion of the polishing member in the processing area, the fluid bearings are activated, the vacuum suction is released, and the polishing member is advanced to the receiving spool. After the advancement of the polishing member, the fluid flow through the fluid bearings is stopped and the polishing member is tensioned on the platen. During the polishing process, a vacuum suction may also be applied through the fluid bearings to further secure the polishing member in place.

In one aspect of the invention, the fluid bearings use a fluid cushion created by exhausting a fluid (e.g., air, water, or other gases or liquids or gels) from holes in the surface of the fluid bearings. As opposed to conventional barrel rollers that employ an internal bearing over a fixed axle, the fluid bearing design allows for reduced resistance and/or friction against the movement of the polishing member.

Figure 2C:
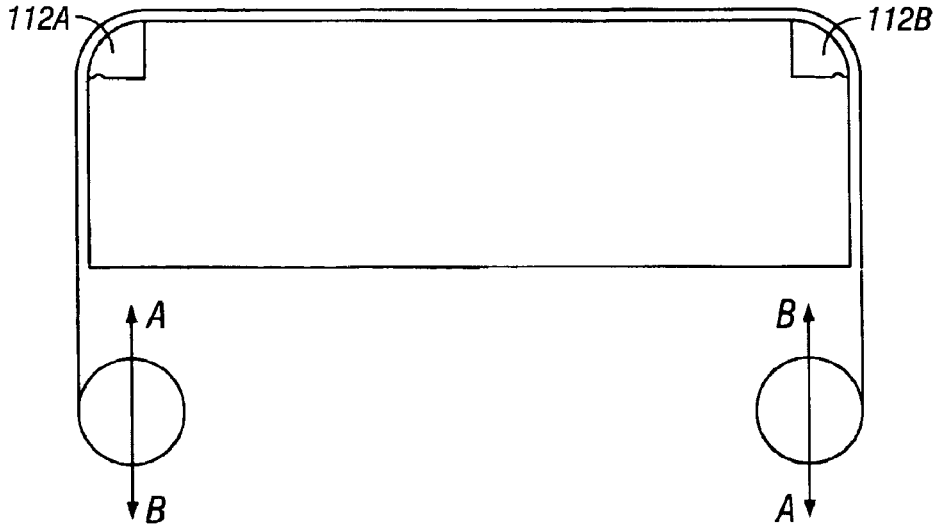
FIGS. 2C–D illustrate a polishing apparatus using linear polishing according to an embodiment of the invention.
Figure 2D:
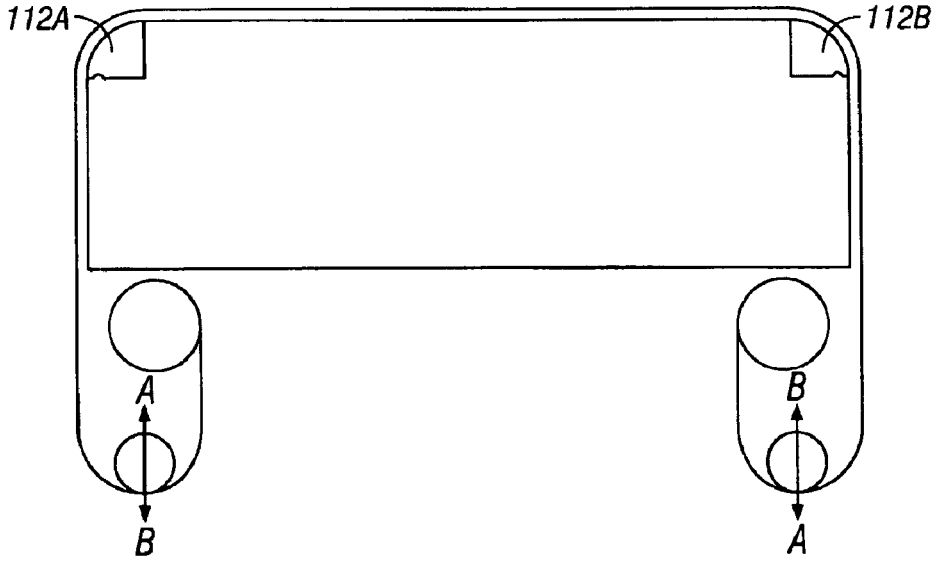

FIGS. 2C–D illustrate a polishing apparatus using linear polishing according to an embodiment of the invention. These embodiments are more fully described in U.S. Pat. Nos. 6,103,628, 6,468,139, and 6,464,571, incorporated herein by reference. In the present invention, the bearings 112A and 112B are fluid bearings as described above with reference to FIGS. 2A–B.

Figure 3:
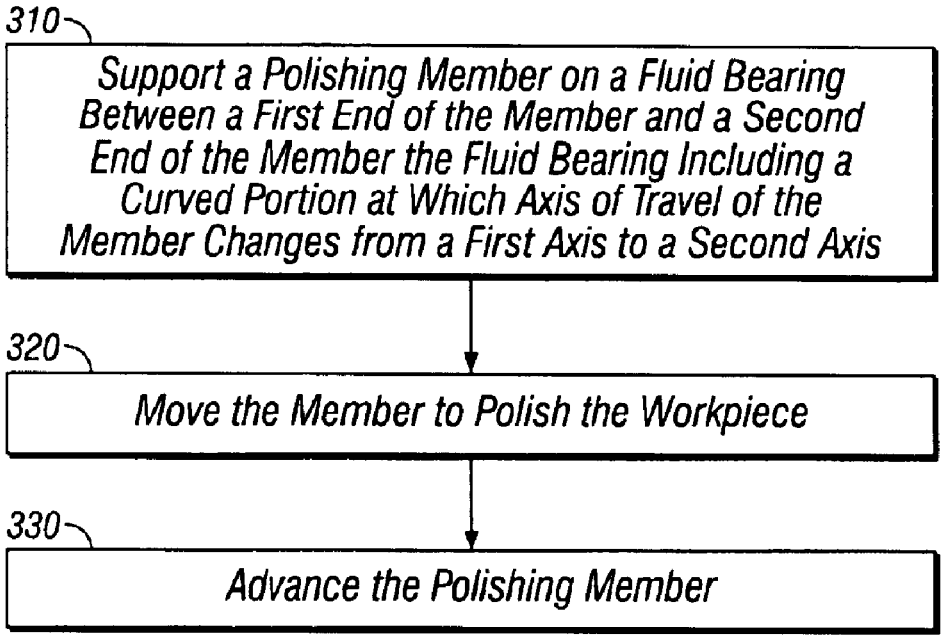
FIG. 3 is a flow diagram of an embodiment of a method of polishing a workpiece.

FIG. 3 is a flow diagram of an embodiment of a method of polishing a workpiece, for example, using the polishing apparatus 200. In step 310, a polishing member is supported on a fluid bearing between a first end of the polishing member and a second end of the polishing member. The fluid bearing includes a curved portion at which plane of travel of the polishing member changes from a first plane to a second plane. For example, the travel of the polishing member may change from moving in a horizontal plane to moving in a vertical plane, or vice versa, at the curved portion of the fluid bearing. In step 320, the polishing member is moved to polish the workpiece. The moving step may include the step of bi-directionally moving the polishing member. Finally, in step 330, the polishing member is advanced to provide a fresh polishing member.

A polishing member drive system 100 that is preferably used to cause bi-linear reciprocating movement of a portion of the polishing member within the processing area will now be described.

Figure 4:
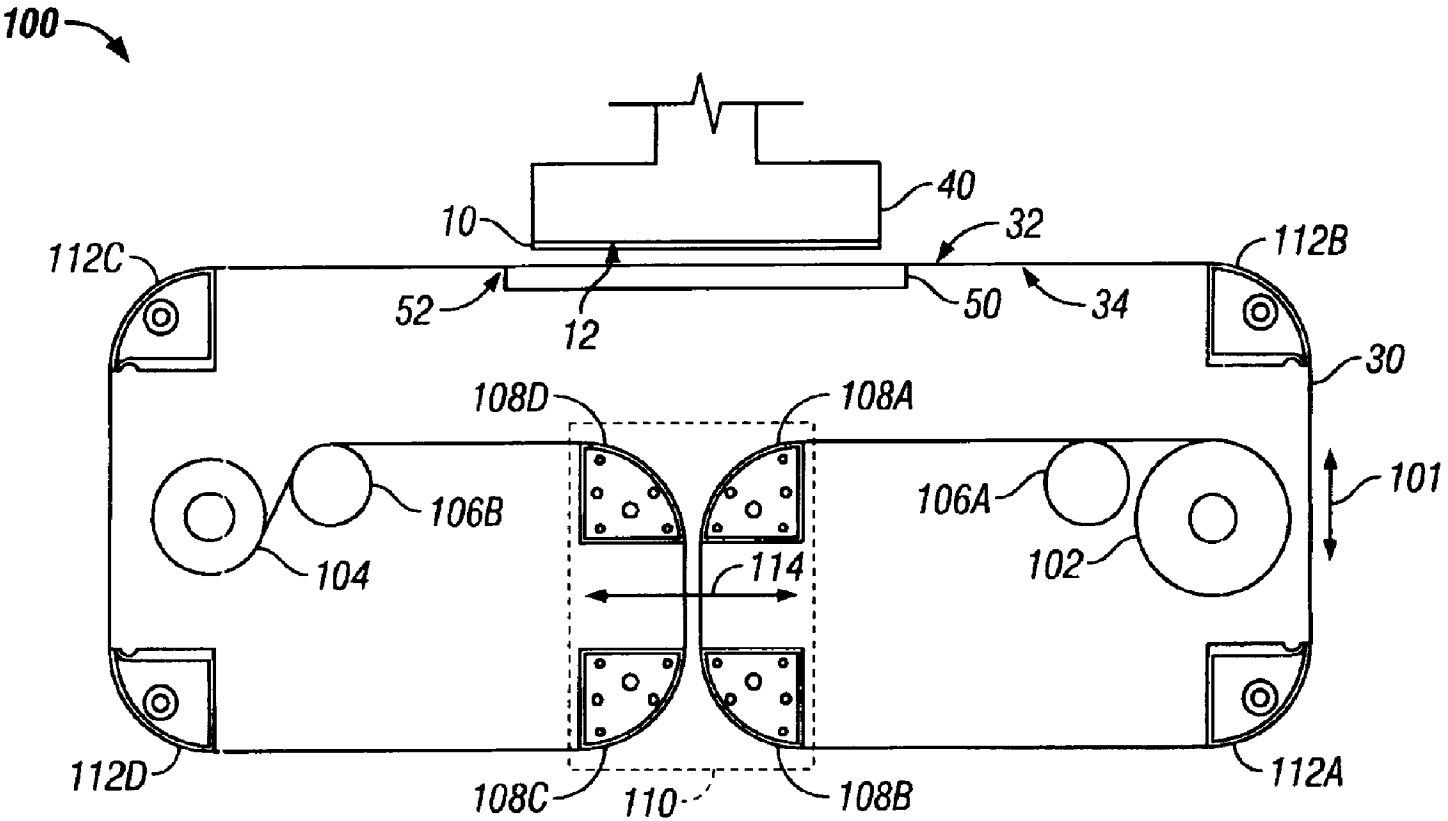
FIG. 4 illustrates a polishing member drive system that is preferably used to cause bi-linear reciprocating movement of the portion of the polishing member within the processing area.

FIG. 4 illustrates a path 101 that the polishing member 30 travels within the polishing member drive system 100 between the supply spool 102 and the receive spool 104. As shown in FIG. 4, the path 101 includes passing from the supply spool 102 over an alignment roller 106A through a top 108A and a bottom 108B right fluid bearing of a slide member 110, and then over each of fluid bearings 112A–112D in a rectangularly shaped path and then around each of a bottom 108C and a top 108D left fluid bearings of the slide member 110, then over an alignment roller 106B and finally to the receive spool 104. Bi-linear movement of the slide member 110 along the horizontal plane 114 will cause the polishing member 30 to move in bi-linear fashion. Thus, the portion of the polishing member 30 disposed within a processing area of the chemical mechanical polishing apparatus can polish a top front surface of a wafer using the bi-directional linear movement of the portion of the polishing member 30.

As previously mentioned, the bi-linearly moving portion of the polishing member 30 is supported above the platen support 50 in the processing area, such that a frontside 32 of the polishing member 30 contacts the front surface 12 of the wafer 10, and the backside 34 of the polishing member 30 levitates over the top surface 52 of the platen support 50. The movement mechanism of the polishing member 30 and the details of the drive system are described in U.S. Pat. No. 6,589,105 and U.S. Prov. No. 60/400,542, incorporated herein by reference.

Figure 5:
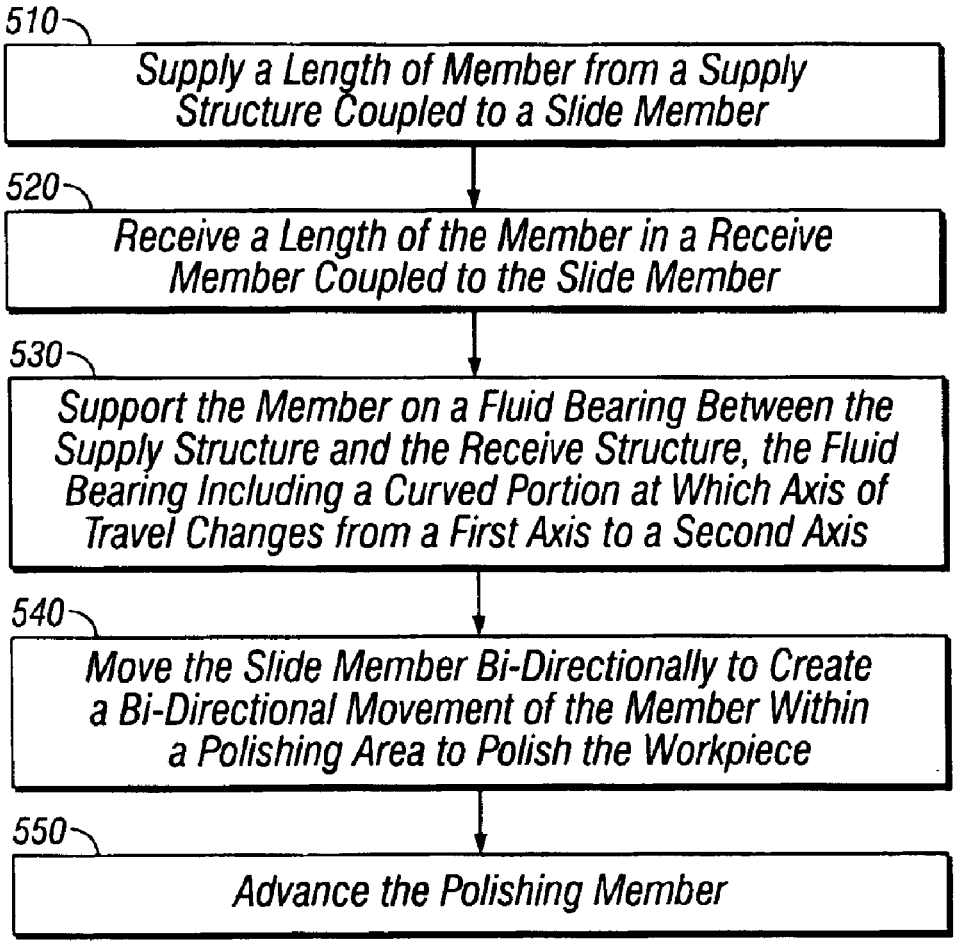
FIG. 5 depicts a flow diagram of an embodiment of a method of polishing a workpiece with a polishing member using bi-directional linear movement.

FIG. 5 is a flow diagram of an embodiment of a method of polishing a workpiece with a polishing member using bi-directional linear movement, for example, using the polishing member drive system 100. In step 510, a length of polishing member is supplied from a supply structure coupled to a slide member. In step 520, a length of polishing member is received in a receive member coupled to the slide member. In step 530, the polishing member is supported on a fluid bearing between the supply structure and the receive structure. The fluid bearing includes a curved portion at which plane of travel of the polishing member changes from a first plane to a second plane. In step 540, the slide member is moved bi-directionally to create a bi-directional movement of the polishing member within a polishing area to polish the workpiece. Finally, in step 550, the polishing member is advanced to provide a fresh section of the polishing member within the polishing area.

Figure 6A:
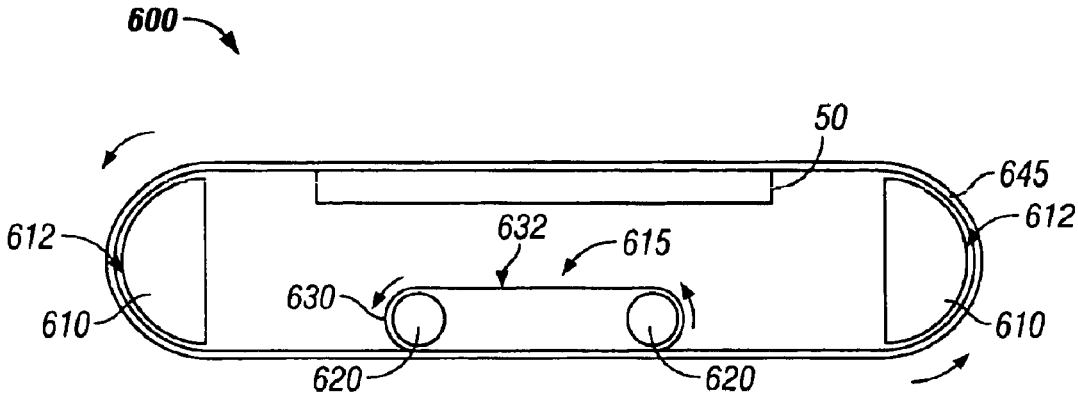
FIG. 6A illustrates an example in which a polisher uses a loop-shaped polishing member which is linearly moved by a moving mechanism.
Figure 6B:
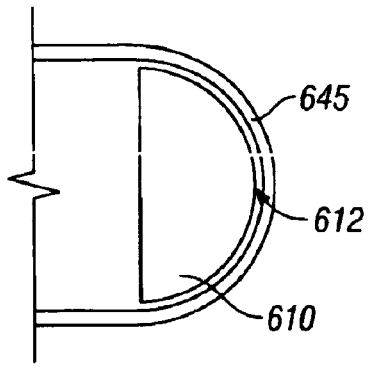
FIG. 6B illustrates the loop-shaped polishing member of FIG. 6A elevated by fluid pressure from a fluid bearing.

In another embodiment, the fluid bearings may be used in various types of polishing apparatuses that use a static polishing member or linearly moving polishing member. FIG. 6A illustrates an example in which a polisher 600 uses a loop-shaped polishing member 645 that is linearly moved by a moving mechanism 615. The moving mechanism may have a drive belt 630 with a tractional surface 632 which grips the backside of the polishing member 645. In one aspect of the invention, the drive belt 630 moves linearly around movement rollers 620, thereby causing the polishing member to move linearly. The polishing member passes over a platen 50 and a surface 612 of fluid bearings 610. Fluid bearings 610 have a semi-circular shape. A wafer placed across the platen 50 can be polished by the linearly moving polishing member. FIG. 6B shows the polishing member 645 elevated by the fluid pressure from a fluid bearing 610. When the polishing member is moved by the moving mechanism, the fluid bearings are activated to elevate the polishing member above the fluid bearing.

Figure 7A:
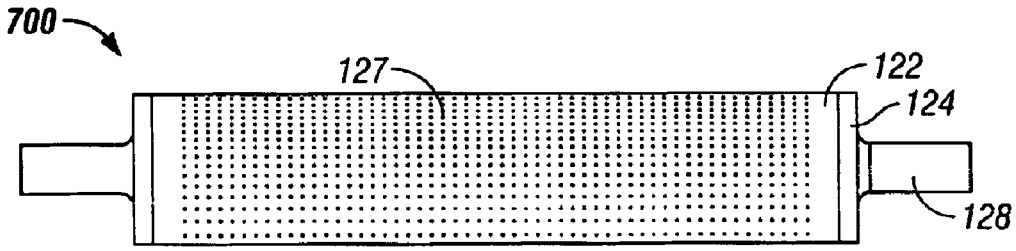
FIGS. 7A and 7B illustrate a fluid bearing depicted in side view and cross-section, respectively.
Figure 7B:
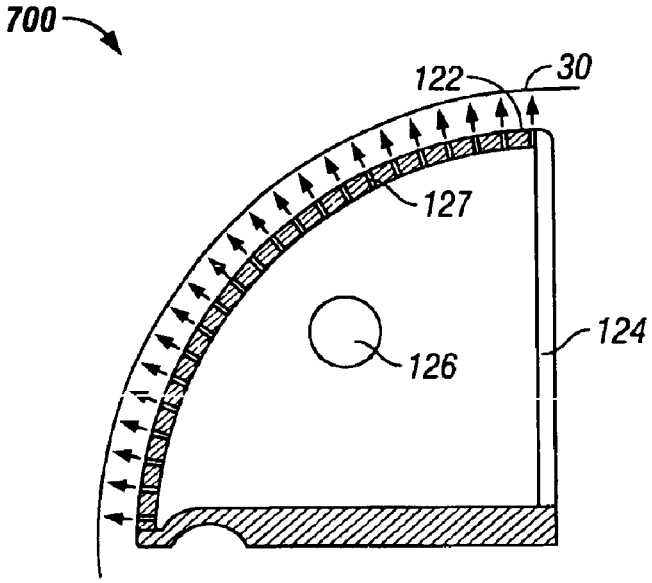

Referring to FIGS. 7A–B, a fluid bearing, such as one of fluid bearings 108A–108D or 112A–112D, is depicted in side view and cross-section, respectively. In one aspect, the fluid bearings may be machined from a metal block as a single piece or as a combination of more than one piece. In another aspect, the fluid bearing may be constructed as a substantially hollow structure from stainless steel, titanium, structural plastic(s), composite(s) or another material. The fluid bearing may have a bearing surface 122 which mates with a fluid housing 124. In one aspect, the bearing surface is precision machined. The fluid housing may feature a fluid supply passage 126 located at both sides of the fluid housing. The fluid supply passage supplies the fluid bearing with pressurized fluid. Alternate configurations of the fluid supply passage are also contemplated. The pressurized fluid introduced by the fluid supply passage leaves the fluid bearing through a plurality of fluid holes 127 formed in the bearing surface. The fluid bearings may also include a pair of anchoring rods 128. The anchoring rods allow for internal mounting of the fluid bearing within a polishing member assembly that uses conventional rollers.

In the aspect shown in FIG. 7B, the fluid housing has an elongated L-shape. The bearing surface is a curved rectangular plate enclosing the fluid housing. The bearing surface is preferably configured to have a perfect quadrant shape to allow the polishing member to smoothly bend 90° in its vicinity. A fluid supply unit provides fluid pressure that is delivered to the fluid bearing by a fluid line (an approximate fluid pressure range 50–70 psi). The fluid is exhausted from the fluid holes, thereby creating the fluid bearing cushion.

Figure 7C:
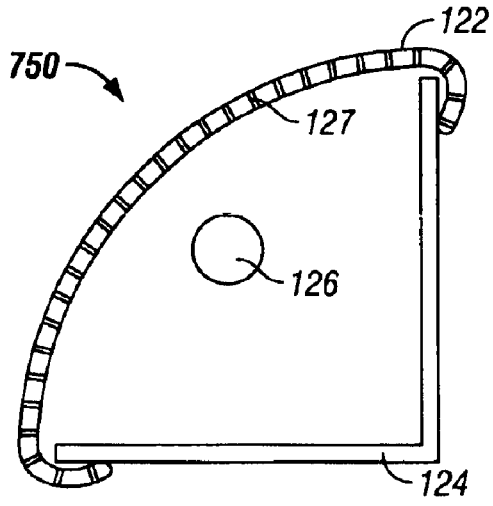
FIG. 7C depicts another aspect of a fluid bearing, shown in cross-section.

FIG. 7C depicts another aspect of a fluid bearing 750, shown in cross-section. In the aspect depicted in FIG. 7C, the fluid bearing is constructed using a one piece bearing surface 122 and a one piece fluid housing 124, creating a substantially hollow structure. As shown, the bearing surface is folded over the fluid housing. Fluid holes 127 allow fluid to be exhausted through the bearing surface by perforating the font surface. By constructing the fluid bearing with the two piece folded construction depicted in FIG. 7C, friction against the polishing member can be further reduced because the polishing member only contacts the bearing surface, which is one piece and does not have any seams or roughness that might exist at the joining with another piece. Additionally, the fluid bearing construction depicted in FIG. 7C allows the fluid bearing to be constructed using inexpensive fabrication techniques and inexpensive materials, such as sheet metal or plastic.

Figure 8:
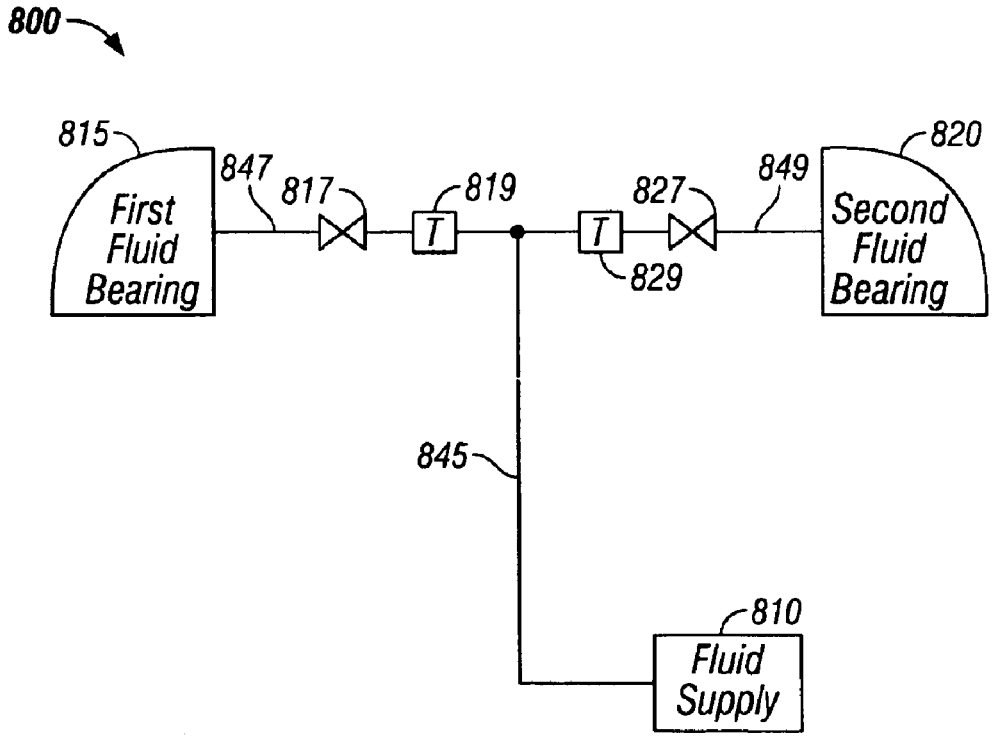
FIG. 8 depicts an embodiment of a system for regulating the pressure and/or the temperature of fluid sent to the fluid bearings.

FIG. 8 depicts an embodiment of the invention for regulating the pressure and/or the temperature of the fluid delivered to the fluid bearings. In one aspect, the pressure and/or temperature of the fluid supplied to the fluid bearings are individually regulated for each fluid bearing. The exemplary system depicted in FIG. 8 has two fluid bearings, though systems having any number of fluid bearings are contemplated. A fluid supply 810 is coupled to the fluid bearings 815 and 820 via a main fluid line 845. The main fluid line splits into two lines; a first fluid line 847 which leads to a first fluid bearing 815, and a second fluid line 849 which leads to a second fluid bearing 820. The fluid pressure supplied to the first fluid bearing 815 is individually controlled by a pressure regulator 817. The fluid temperature supplied to the first fluid bearing 815 is individually controlled by a temperature regulator 819. Additionally, with respect to the second fluid bearing 820, the supplied fluid pressure is regulated by a second pressure regulator 827 and the fluid temperature is regulated by a second temperature regulator 829. In another aspect of the invention, the temperature and/or pressure of the fluid supplied to all of the fluid bearings in the system is regulated collectively.

Advantages of the invention include reduced handling of the polishing member, which can extend the useful life of the polishing member and reduce defects introduced by fluctuations from surfaces rubbing against one another. The use of fluid bearings also reduces rolling resistance and angular momentum on the polishing member, as compared to conventional rollers. Further, the fluid bearing design may allow for better tension control of the polishing member than with conventional rollers.

Having disclosed exemplary embodiments and the best mode, modifications and variations may be made to the disclosed embodiments while remaining within the subject and spirit of the invention as defined by the following claims.

What is claimed is:

1. An apparatus for polishing a workpiece comprising:

a polishing member configured to polish the workpiece;

a support structure coupled to the polishing member and configured to move the polishing member to polish the workpiece; and wherein the support structure includes at least one curved fluid bearing coupled to the polishing member and configured to support the polishing member while it is moved to polish the workpiece, wherein the fluid bearing supports the polishing member over a region where the polishing member plane of travel changes from a first plane to a second plane.

2. The apparatus of claim 1, further comprising a pressure regulator configured to control pressure of a fluid exhausted from the fluid bearing.

3. The apparatus of claims 1, further comprising a temperature regulator configured to control temperature of a fluid exhausted from the fluid bearing.

4. The apparatus of claim 1, wherein:

the support structure includes at least two curved fluid bearings coupled to the polishing member and configured to support the polishing member while it is moved to polish the workpiece.

5. The apparatus of claim 1, wherein the fluid bearing is a substantially hollow structure with a curved portion constructed from perforated sheet metal.

6. The apparatus of claim 1, wherein the support structure includes:

a supply spool configured to supply the polishing member and a receive spool configured to receive the polishing member, and a slide member coupled to the supply spool and the receive spool and configured to move the polishing member in a bi-linear manner.

7. The apparatus of claim 1, wherein the support structure includes:

a supply spool configured to supply the polishing member and a receive spool configured to receive the polishing member; and a slide member coupled to the supply spool and the receive spool and configured to move the polishing member in a bi-linear manner.

8. The apparatus of claim 4, wherein the support structure includes;

a supply spool configured to supply the polishing member and a receive spool configured to receive the polishing member; and a slide member coupled to the supply spool and the receive spool and configured to move the polishing member in a bi-linear manner.

9. A method of polishing a workpiece comprising the steps of:

supporting a polishing member on a fluid bearing between a first end of the polishing member and a second end of the polishing member, the fluid bearing having a curved portion over which the polishing member is redirected from travel on a first plane to travel on a second plane; and moving the polishing member to polish the workpiece.

10. The method of claim 9, wherein the moving step includes bi-directionally moving the polishing member.

11. The method of claim 10 further comprising the step of regulating pressure of a fluid exhausted from the fluid bearing.

12. The method of claim 11 further comprising the step of regulating temperature of a fluid exhausted from the fluid bearing.

13. The method of claim 9 further comprising the step of regulating temperature of a fluid exhausted from the fluid bearing.

14. The method of claim 13, further comprising regulating pressure of a fluid exhausted from the fluid bearing.

15. The method of claim 9, further comprising regulating pressure of a fluid exhausted from the fluid bearing.

16. The method of claim 9 further comprising the steps of:

supplying a length of the polishing member from a supply structure coupled to a slide member;

receiving a length of the polishing member in a receive structure coupled to the slide member;

wherein the moving step includes bi-directionally moving the slide member to create a bi-directional movement of the polishing member within a processing area to polish the workpiece.

17. The method of claim 16 further comprising regulating pressure of a fluid exhausted from the fluid bearing.

18. The method of claim 16 further comprising regulating temperature of a fluid exhausted from the fluid bearing.

19. The method of claim 17 further comprising regulating temperature of a fluid exhausted from the fluid bearing.

20. The method of claim 16, wherein the fluid bearing includes a first fluid bearing and a second fluid bearing and the polishing member is supported on the first fluid bearing and the second fluid bearing.

21. The method of claim 20 further comprising the step of exhausting a first fluid at a first pressure from the first fluid bearing and exhausting a second fluid at a second pressure from the second fluid bearing.

22. The method of claim 20 further comprising the step of exhausting a first fluid at a first temperature from the first fluid bearing and exhausting a second fluid at a second temperature from the second fluid bearing.

23. The method of claim 21, further comprising the step of exhausting the first fluid at a first temperature from the first fluid bearing and exhausting the second fluid at a second temperature from the second fluid bearing.

* * * * *